United States Patent [19]

Turner et al.

[11] Patent Number: 4,673,488

[45] Date of Patent: Jun. 16, 1987

[54] HYDROCARBON-CONVERSION PROCESS WITH FRACTIONATOR OVERHEAD VAPOR RECYCLE

[75] Inventors: Robert B. Turner, Schaumburg; Kenneth D. Peters, Elmhurst; Richard W. Bennett, Western Springs, all of Ill.

[73] Assignee: UOP Inc., Des Plaines, Ill.

[21] Appl. No.: 769,091

[22] Filed: Aug. 26, 1985

[51] Int. Cl.[4] ..... C10G 47/00

[52] U.S. Cl. ..... 208/101; 208/62; 208/93; 208/94; 208/102; 208/103; 208/104; 208/342; 208/355; 208/364; 585/802; 585/719

[58] Field of Search ..... 208/93, 94, 100, 101, 208/102, 103, 104, 59, 58, 62, 342, 343, 355, 364, 369; 585/802, 719

[56] References Cited

U.S. PATENT DOCUMENTS

| | | | |
|---|---|---|---|
| 3,431,195 | 3/1969 | Storch et al. | 208/101 |
| 3,471,398 | 10/1969 | Borst, Jr. | 208/100 |
| 3,520,800 | 7/1970 | Forbes | 208/101 |
| 3,658,693 | 4/1972 | Hettick et al. | 208/93 |
| 3,753,892 | 8/1973 | Weith | 208/102 |
| 4,159,937 | 7/1979 | Scott | 208/58 |
| 4,364,820 | 12/1982 | DeGraff et al. | 208/101 |
| 4,374,726 | 2/1983 | Schmelzer et al. | 208/101 |

*Primary Examiner*—John Doll
*Assistant Examiner*—Chung K. Pak
*Attorney, Agent, or Firm*—Thomas K. McBride; John F. Spears, Jr.; Richard J. Cordovano

[57] ABSTRACT

An improved method for processing the effluent of a hydrocarbon conversion zone. The invention is particularly useful in a catalytic reforming reaction, wherein practice of the invention results in an increased recovery of butane and propane. The effluent is separated into vapor and liquid components, which are then recontacted at a higher pressure. Several recontacting steps may be employed. Liquid product is then subjected to fractionation. Overhead vapor from the fractionation zone is recycled back to a recontacting step in order to recover a portion of the hydrocarbons contained therein, instead of routing the vapor to the plant fuel gas system.

12 Claims, 3 Drawing Figures

HYDROCARBON-CONVERSION PROCESS WITH FRACTIONATOR OVERHEAD VAPOR RECYCLE

FIELD OF THE INVENTION

This invention relates to hydrocarbon conversion processes which are effected in the presence of hydrogen. More specifically, this invention relates to the recovery of products from effluent streams emanating from hydrocarbon conversion reactions. One application of this invention involves catalytic reforming.

BACKGROUND OF THE INVENTION

Various types of hydrocarbon conversion reaction systems have found widespread utilization throughout the petroleum and petrochemical industries for effecting the conversion of hydrocarbons to a multitudinous number of products. The reactions employed in such systems are either exothermic or endothermic, and usually result in either the net production of hydrogen or the net consumption of hydrogen. These hydrocarbon conversion reactions include those which predominate in catalytic reforming, ethylbenzene dehydrogenation to styrene, propane and butane dehydrogenation, etc.

Petroleum refineries and petrochemical complexes are customarily comprised of numerous reaction systems. Some systems will be net consumers of hydrogen while other systems within the refinery or petrochemical complex may result in the net production of hydrogen. Net hydrogen refers to either the hydrogen which is available from a reaction for use elsewhere or the the hydrogen which must be added to a reaction from a source outside the reaction system. Because hydrogen is a relatively expensive substance, it has become the practice within the art of hydrocarbon conversion to supply hydrogen from reaction systems in which there is net production of hydrogen to reaction systems which are net consumers of hydrogen. Occasionally the hydrogen being passed to the net hydrogen-consuming reaction systems must be of high purity due to the reaction conditions and/or the catalyst employed in the systems. Such a situation may require treatment of the hydrogen from the net hydrogen-producing reaction systems to remove hydrogen sulfide, light hydrocarbons, etc., from the net hydrogen stream.

In some cases, the hydrogen balance for the entire petroleum refinery or petrochemical complex is such that there is excess hydrogen, i.e., the net hydrogen-producing reaction systems produce more hydrogen than is necessary for the net hydrogen-consuming reaction systems. When such is the case, the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkyl-aromatics, dehydrocyclodimerization (primarily aromatization of propane), and catalytic dehydrogenation of paraffins. Commonly employed net hydrogen-consuming reaction systems are hydrotreating, hydrocracking and catalytic hydrogenation. Of the above mentioned net hydrogen-producing and consuming hydrocarbon reaction systems, catalytic reforming ranks as one of the most widely employed. By virtue of its wide application and its utilization as a primary source of hydrogen for the net hydrogen-consuming reaction systems, catalytic reforming has become well known in the art of hydrocarbon conversion reaction systems. Accordingly the following discussion of the invention will be in reference to its application to a catalytic reforming reaction system. However, the following discussion should not be considered as unduly limiting the broad scope of the invention, which has wide application in many hydrocarbon conversion reaction systems. For example, another application is to a catalytic process referred to as dehydrocyclodimerization, wherein two or more molecules of a light aliphatic hydrocarbon, such as propane, are joined together to form a product aromatic hydrocarbon. Those having ordinary skill in the art will well recognize the broad application of the present invention and the following will enable them to apply the invention in all its multitudinous embodiments.

It is well known that high quality petroleum products in the gasoline boiling range including, for example, aromatic hydrocarbons such as benzene, toluene, and the xylenes, are produced by a catalytic reforming process where a naphtha fraction is passed to a reaction zone and contacted with a platinum-containing catalyst in the presence of hydrogen. Generally, the catalytic reforming reaction zone effluent, comprising gasoline boiling range hydrocarbons, light hydrocarbons, and hydrogen, is passed to a vapor-liquid equilibrium separation zone and is therein separated into a hydrogen-containing vapor phase and an unstablized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroluem refinery or petrochemical complex fuel system.

Because the dehydrogenation of naphthenic hydrocarbons is one of the predominant reactions of a reforming process, substantial amounts of hydrogen are generated within a catalytic reforming reaction zone. Accordingly a net excess of hydrogen is available for use as fuel or for use in a net hydrogen-consuming process, such as the hydrotreating of sulfur-containing petroleum feedstocks. However, catalytic reforming also involves a hydrocracking function, among the products of which are relatively low molecular weight hydrocarbons, including methane, ethane, propane, butanes and pentanes. Substantial amounts of these appear in the hydrogen-containing vapor phase which is separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons, which are valuable as products or feedstock for other processes. It is therefore advantageous to devise a method of purifying the hydrogen-containing vapor phase to produce a hydrogen-rich gas stream and to recover valuable components such as $C_3+$ hydrocarbons.

Separation of hydrogen from the hydrocarbon conversion products of a hydrogen-producing hydrocarbon conversion process is generally effected by cooling the reactor effluent and separating, by means of a vapor-liquid equilibrium separation vessel, a hydrogen-rich vapor phase and a liquid hydrocarbon phase. The hydrogen-containing vapor phase is often subsequently recontacted with at least a portion of the liquid hydrocarbon phase, whereby residual hydrocarbons are absorbed from the vapor phase into the liquid hydrocarbon phase. This recontacting process may be repeated one or more times, generally at increasingly higher pressures, to enhance the purity of the hydrogen-containing vapor phase and also enhance the recovery of hydrocarbon conversion products.

The liquid hydrocarbon phase is subsequently treated in a fractionation zone which is comprised of one or more fractionation columns and equipment which is auxiliary thereto, such as heat exchangers, pumps, and separators. The first fractionation column in the fractionation zone is often a stabilizer or debutanizer. The bottoms product from a debutanizer comprises $C_5+$ hydrocarbons. The term "stabilizer" is used when significant amounts of butane are left in the heavy hydrocarbon product stream. The overhead component from the debutanizer or stabilizer column is cooled and passed to a vapor-liquid separator to provide two overhead products, overhead vapor and overhead liquid. The overhead vapor is comprised primarily of hydrogen and $C_4-$ hydrocarbons and is normally used as fuel. Net overhead liquid consists primarily of $C_2$, $C_3$, and $C_4$ hydrocarbons and it is often processed further to obtain a butane fraction and a propane fraction.

The overhead liquid may be treated in a fractionation column commonly known as a deethanizer, where $C_2-$ hydrocarbons are removed as an overhead vapor stream for use as fuel. The deethanizer bottoms stream is usually fed to another fractionation column for separation into propane and butane.

BRIEF SUMMARY OF THE INVENTION

This invention provides an efficient method for separating the effluent from a hydrocarbon conversion zone into the particular products desired. In a broad embodiment, the invention is a process for recovering the products of a hydrogen-producing hydrocarbon conversion reaction which comprises: passing a partially condensed reaction zone effluent stream comprising $C_5+$ hydrocarbons, methane, ethane, propane, butane, and hydrogen into a vapor-liquid separation zone which comprises at least two vapor-liquid separators and in which at least one vapor-liquid contacting step is performed and wherein said effluent stream is separated into a hydrogen-rich net gas stream and a liquid stream; passing the liquid stream into a fractionation zone comprising at least one fractionation column and recovering therefrom a heavy hydrocarbon stream, an overhead vapor stream, and a overhead liquid stream; and, passing at least a portion of the net overhead vapor stream into said vapor-liquid separation zone and mixing it with a feed stream to a vapor-liquid separator.

In catalytic reforming, an embodiment of the invention provides a method to separate the effluent into a hydrogen-rich gas stream, a hydrocarbon stream primarily comprised of $C_3$ and $C_4$ hydrocarbons, and a heavy hydrocarbon stream comprising $C_5+$ hydrocarbons. Compared to prior art methods this invention provides a gas stream having a greater quantity of hydrogen and an overhead liquid stream containing greater quantities of $C_3$ and $C_4$ hydrocarbons.

In order to accomplish this, in one embodiment of the invention, overhead vapor from a debutanizer or stabilizer is recycled back to one of the recontacting steps instead of being used in the fuel gas system. In another embodiment, in systems in which the fractionation zone includes a deethanizer, overhead vapor from the deethanizer is combined with debutanizer overhead vapor rather than being used in the fuel gas system. Recycle of deethanizer overhead vapor results in further improvement of product recovery.

It is an object of the present invention to provide an improved method for recovery of high quality products from the effluent emanating from a hydrocarbon conversion process. In particular, it is an object of this invention to improve the recovery of $C_3$ and $C_4$ hydrocarbons and hydrogen from a catalytic reforming process.

In an embodiment wherein the effluent stream emanating from a hydrocarbon conversion reaction zone is treated in three separate vapor-liquid separation zones, the present invention comprises the steps of: (a) passing a partially condensed reaction zone effluent to a first vapor-liquid separation zone maintained at conditions at which most $C_5+$ hydrocarbons are in a liquid phase and recovering therefrom a first hydrogen-containing vapor stream and a first liquid stream; (b) mixing at least a portion of the first hydrogen-containing vapor stream with fractionation zone overhead vapor defined in step (f) and a third liquid stream defined in step (e); (c) passing the mixture of step (b) to a second vapor-liquid separation zone which is maintained at a higher pressure than the first vapor-liquid separation zone and recovering from said second zone a second hydrogen-containing vapor stream and a second liquid stream; (d) mixing at least a portion of the second hydrogen-containing vapor stream with at least a portion of the first liquid stream and passing the resulting mixture to a third vapor-liquid separation zone which is maintained at a higher pressure than the second vapor-liquid separation zone; (e) recovering from said third vapor-liquid separation zone a hydrogen-rich net gas stream and a third liquid stream, at least a portion of which third liquid stream is mixed with the first hydrogen-containing vapor stream in step (b); and, (f) passing said second liquid stream to a fractionation zone and recovering therefrom a light hydrocarbon stream, a heavy hydrocarbon stream, and a fractionation zone overhead vapor stream, at least a portion of which overhead vapor stream is mixed with the first hydrogen-containing vapor stream in step (b).

Where a reaction zone effluent stream is treated in four gas-liquid separators, an embodiment of the present invention comprises the steps of: (a) passing a partially condensed reaction zone effluent to a first vapor-liquid separation zone maintained at conditions at which most $C_5-$ plus hydrocarbons are in a liquid phase and recovering therefrom a first hydrogen-containing vapor stream and a first liquid stream; (b) mixing at least a portion of the first hydrogen-containing vapor stream with fractionation zone overhead vapor defined in step (h) and a third liquid stream defined in step (e); (c) passing the mixture of step (b) to a second vapor-liquid separation zone which is maintained at a higher pressure than the first vapor-liquid separation zone and recovering from said second zone a second hydrogen-containing vapor stream and a second liquid stream; (d) mixing at least a portion of the second hydrogen-containing vapor stream with at least a portion of a fourth liquid stream defined in step (g) and passing the resulting mixture to a third vapor-liquid separation zone which is maintained at a higher pressure than the second vapor-liquid separation zone; (e) recovering from said third vapor-liquid separation zone a third hydrogen-containing vapor stream and a third liquid stream, at least a portion of which third liquid stream is mixed with the first hydrogen-containing vapor stream in step (b); (f) mixing at least a portion of the third hydrogen-containing vapor stream with at least a portion of the first liquid stream and passing the resulting mixture to a fourth vapor-liquid separation zone which is maintained at a higher pressure than the third vapor-liquid separation zone; (g) recovering from the fourth vapor-liquid separation zone a hydrogen-rich net gas stream and a fourth liquid stream, at least a portion of which fourth liquid stream is mixed with the second hydrogen-containing vapor stream in step (d); and, (h) passing said second liquid stream to a fractionation zone and recovering therefrom a light hydrocarbon stream; a heavy hydrocarbon stream, and a fractionation zone overhead vapor stream, at least a portion of which overhead vapor stream is mixed with the first hydrogen-containing vapor stream in step (b).

The fractionation zone overhead vapor which is mixed with a hydrogen-containing vapor stream may emanate from a deethanizer overhead vessel and/or a debutanizer overhead vessel and/or a depropanizer overhead vessel.

INFORMATION DISCLOSURE

The prior art recognizes myriad process schemes for the obtention and purification of a hydrogen-rich gas stream from the effluent of hydrocarbon conversion reaction zones. U.S. Pat. No. 3,431,195, issued Mar. 4, 1969, discloses such a scheme. The hydrogen and hydrocarbon effluent of a catalytic reforming zone is first passed to a low pressure vapor-liquid equilibrium zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium zone. Because the second zone is maintained at a higher pressure, a new vapor-liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich net gas stream relatively free of $C_3$–$C_6$ hydrocarbons.

U.S. Pat. No. 4,374,726 issued Feb. 22, 1983, discloses another method of obtaining a high-purity hydrogen gas stream from the reaction zone effluent of a catalytic reforming process. In this reference, the reaction zone effluent is passed to a vapor-liquid equilibrium zone to produce a first hydrocarbon liquid phase and a hydrogen-containing vapor phase. A first portion of the hydrogen-containing vapor phase is compressed and recycled to the catalytic reforming reaction zone. A second portion of the hydrogen-containing vapor phase is compressed and thereafter recontacted with the first liquid hydrocarbon phase from the vapor-liquid equilibrium zone. The resulting admixture is then passed to a second vapor-liquid equilibrium zone to produce a hydrogen gas stream of high purity and a second liquid hydrocarbon phase comprising unstabilized reformate. The second liquid phase is fed to a fractionation column known as a stabilizer, from which three separate streams are recovered. The overhead vapor product may be used as fuel. The overhead liquid product is comprised primarily of $C_3$ and $C_4$ hydrocarbons. The bottom product is reformate which contains mainly $C_6$+ hydrocarbons.

U.S. Pat. No. 4,364,820, issued Dec. 21, 1982, discloses a more complex method of recovering high purity hydrogen gas from a catalytic reforming reaction zone effluent. In this reference the reaction zone effluent is first separated in a vapor-liquid equilibrium zone into a first hydrogen-containing vapor phase and a first liquid hydrocarbon phase. One portion of the first hydrogen-containing vapor phase is compressed and recycled back to the catalytic reaction zone. The balance of the hydrogen-containing vapor phase is compressed and contacted with a second liquid hydrocarbon phase recovered from a hereinafter described third vapor-liquid equilibrium zone. The admixture is then passed to a second vapor-liquid equilibrium zone from which is derived a third liquid hydrocarbon phase comprising unstabilized reformate and a second hydrogen-containing vapor phase of higher purity than the first hydrogen-containing vapor phase derived from the first vapor-liquid equilibrium zone. The second hydrogen-containing vapor phase is subjected to compression and then contacted with the first liquid hydrocarbon phase from the first vapor-liquid equilibrium zone. The resulting admixture is then passed to a third vapor-liquid equilibrium zone from which is derived a hydrogen gas stream of high purity and the aforementioned second liquid hydrocarbon phase. The third liquid hydrocarbon phase is passed to a fractionation column. An overhead vapor stream produced in the fractionation zone is discharged from the system.

U.S. Pat. No. 3,520,800, issued July 14, 1970, discloses another method of obtaining a hydrogen-rich gas stream from a catalytic reforming reaction zone effluent. As in the previously discussed methods, the reforming reaction zone effluent is passed to a first vapor-liquid equilibrium zone from which is obtained a first hydrogen-containing vapor phase and a first unstabilized hydrocarbon liquid phase. The hydrogen-containing vapor phase is compressed and recontacted with the hydrocarbon liquid phase. Thereafter the mixture is passed to a second vapor-liquid equilibrium zone maintained at a higher pressure than the first vapor-liquid equilibrium zone. A second hydrogen-containing vapor phase of higher hydrogen purity is recovered from the second vapor-liquid equilibrium zone with a portion thereof being recycled back to the catalytic reforming reaction zone. The remaining amount of the resulting hydrogen-containing vapor phase is passed to a cooler wherein the temperature of the phase is reduced to a value at least 20 degrees F. (11 degrees C.) lower than the temperature maintained in the second vapor-liquid equilibrium zone. After cooling, the hydrogen phase is passed to a third vapor-liquid equilibrium zone from which a high-purity hydrogen gas stream is recovered. Liquid from the second and third vapor-liquid equilibrium zones is passed to a fractionation column, from which a light hydrocarbon and hydrogen stream, or overhead vapor stream, is discharged.

DETAILED DESCRIPTION OF THE INVENTION

A detailed example will now be utilized as a vehicle to explain the invention.

Figure 1:
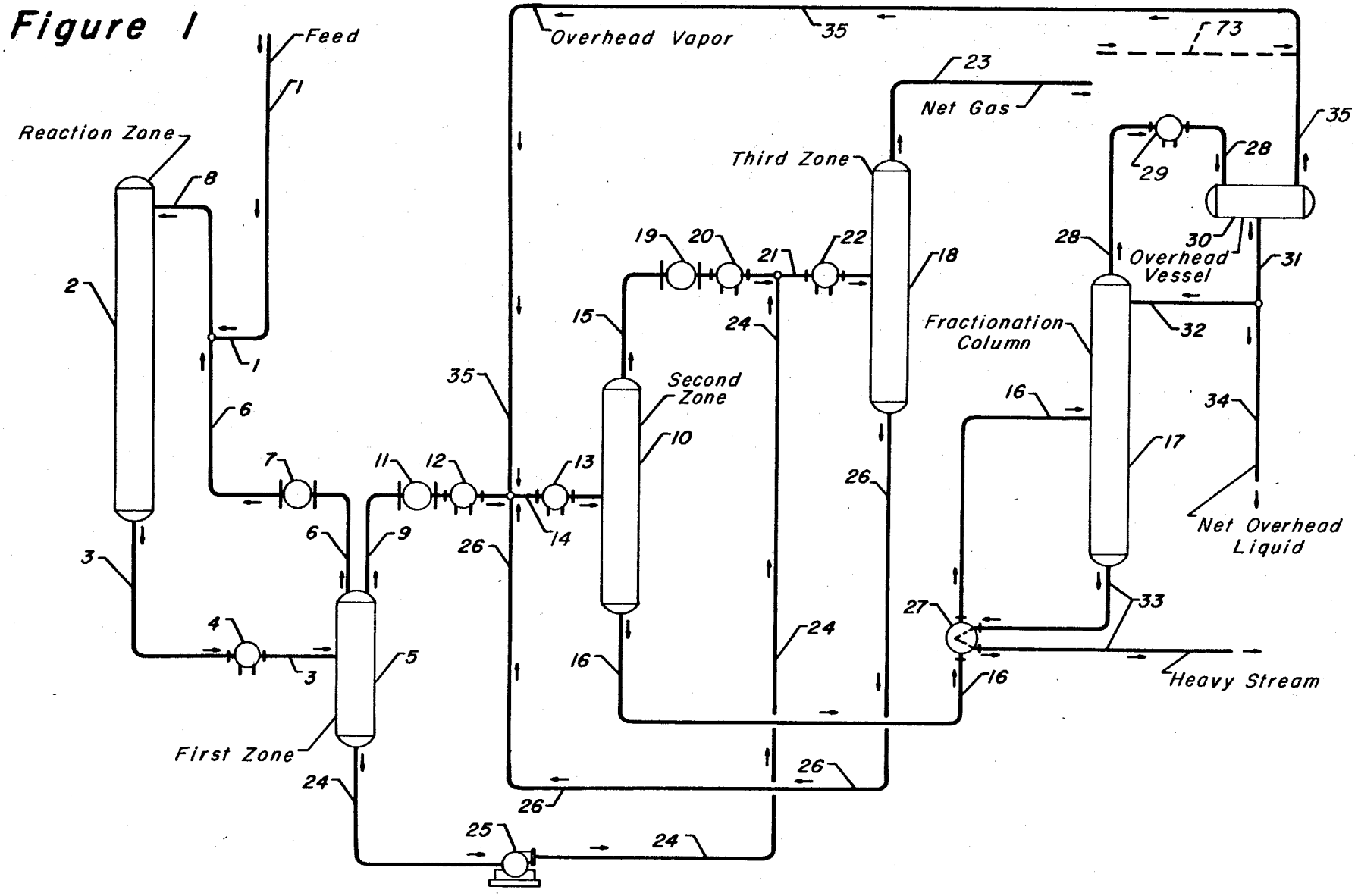
FIG. 1 is a schematic representation of a hydrocarbon conversion process wherein three vapor-liquid separation zones are utilized to process a reaction zone effluent prior to passing a liquid fraction separated out in said zones to a fractionation zone. In accordance with the invention, overhead vapor from the fractionation zone is recycled back to the vapor-liquid separation zones.

The embodiment of the invention depicted in FIG. 1 will be used in the detailed example. Use of the example is not intended to limit the broad scope of the invention. FIG. 1 (and the other drawings) is not intended as an undue limitation on the generally broad scope of the invention as set out in the appended claims. Only those compressors, heat exchangers, pumps, etc. that are useful in the description of the process are shown. Other hardware such as pumps, furnaces, and instrumentation and controls has been omitted as not essential to a clear understanding of the process, the use of such hardware being well within the purview of one skilled in the art.

Referring to FIG. 1, there is shown a catalytic reforming reaction zone 2, vapor-liquid separation zones 5, 10 and 18, and a fractionation column 17, which may also be referred to as a debutanizer. In one preferred embodiment, a petroleum-derived naphtha fraction feed boiling in the 180–400 degrees F. (82–204 degrees C.) range is introduced to the process via line 1 and admixed with a hereinafter described hydrogen recycle stream from line 6. The combined stream passes through line 8 and through a heating means, not shown, to enter catalytic reforming zone 2. The catalytic reforming zone will typically comprise a plurality of stacked or side-by-side reactors with provisions for intermediate heating of the reactant stream.

The catalytic reforming art is largely concerned with the treatment of a gasoline boiling range petroleum fraction to improve its anti-knock characteristics. The petroleum fraction may be a full boiling range gasoline fraction having an initial boiling point in the 50°–100 degrees F. (10–38 degrees C.) range and an end boiling point in the 325–425 degrees F. (163–218 degrees C.) range. More frequently, the gasoline fraction will have an initial boiling point in the 150–250 degrees F. (66–112 degrees C.) range and an end boiling point in the 350–425 degrees F. (177–218 degrees C.) range, this higher boiling fraction being commonly referred to as naphtha. The reforming process is particularly applicable to the treatment of those straight-run gasolines comprising relatively large concentrations of naphthenic and substantially straight chain paraffinic hydrocarbons which are amenable to aromatization through dehydrogenation and/or cyclization. Various other concomitant reactions also occur, such as isomerization and hydrogen transfer, which are beneficial in upgrading the selected gasoline fraction.

Widely accepted catalysts for use in the reforming process typically comprise platinum on an alumina support. These catalysts will generally contain from about 0.05 to about 5 wt. % platinum. More recently, certain promoters or modifiers, such as cobalt, nickel, rhenium, germanium and tin, have been incorporated into the reforming catalyst to enhance the reforming operation.

Catalytic reforming is a vapor phase operation effected at hydrocarbon conversion conditions which include a temperature of from about 500 degrees to about 1050 degrees F. (250–566 degrees C.). Other reforming conditions include a pressure of from about 50 to about 1000 psig (345–6895 kPa) and a liquid hourly space velocity (defined as liquid volume of fresh charge per volume of catalyst per hour) of from about 0.2 to about 10. The reforming reaction is carried out in the presence of sufficient hydrogen to provide a hydrogen to hydrocarbon mole ratio of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor, or the catalyst beds may each be enclosed at a separate reactor in a side-by-side reactor arrangement. Generally, a reaction zone will comprise from 2 to 4 catalyst beds in either a stacked or side-by-side configuration. The amount of catalyst used in each of the catalyst beds may be varied in accordance with the endothermic heat of reaction in each stage, since the effluent from each stage except the last is normallly reheated before being fed to another stage. For example, in a three catalyst bed system, the first bed will generally contain from about 10 to about 30 vol. %, the second from about 25 to about 45 vol. %, and the third from about 40 to about 60 vol. %. With respect to a four catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth.

The reforming operation further includes the separation of a hydrogen-rich vapor phase and a liquid hydrocarbon phase from the reaction zone effluent stream. The phase separation is initially accomplished at a pressure which is substantially the same as the reforming pressure, allowing for pressure drop through the reactor system, and at substantially reduced temperature relative to the reforming temperature—typically from about 60 degrees to about 140 degrees F. (16–60 degrees C.). Accordingly, in the present example, the reaction zone effluent stream is passed into a first gas-liquid separation zone at said temperature of from about 60 degrees to about 140 degrees F. (15–60 degrees C.) and at a pressure of from about 50 to about 150 psig (345–1034 kPa). This initial separation yields a hydrocarbon phase and a hydrogen-rich vapor phase which is generally suitable for recycle purposes.

Returning to FIG. 1, the effluent from reforming zone 2 is recovered in line 3 and passed through cooling means 4 into a first gas-liquid separation zone 5 at a temperature of about 100 degrees F. (38 degrees C.). The liquid hydrocarbon phase that settles out in said first separation zone comprises about 0.6 mole % hydrogen and $C_1$–$C_2$ hydrocarbons. This liquid hydrocarbon phase is withdrawn through line 24 to be utilized as hereinafter described. One portion of the hydrogen-rich vapor phase, comprising about 94 mole % hydrogen is recovered through an overhead line 6 and recycled to the reforming zone 2. The recycle hydrogen is processed through a recycle compressor 7, admixed with the previously described naphtha feedstock from line 1, and the combined stream enters the reforming zone 2.

The balance of the hydrogen-rich vapor phase is recovered from the first separation zone 5 via line 9 and recontacted with a liquid hydrocarbon phase from line 26, said liquid phase originating from a third gas-liquid, or vapor-liquid, separation zone 18 as hereinafter described. Also mixed with the hydrogen-rich vapor phase and the liquid stream, in accordance with the present invention, is a fractionation zone overhead vapor stream from line 35. The combined stream is then treated in a second gas-liquid separation zone 10 at an elevated pressure relative to said first separation zone. Increasing the pressure promotes extraction of higher molecular weight residual hydrocarbons from the vapor phase and separation of residual hydrogen and lighter $C_1$–$C_2$ hydrocarbons from the liquid phase. As will hereinafter appear, the second separation zone 5 provides the final recontacting of the liquid hydrocarbon phase while the hydrogen-rich vapor phase is subsequently further recontacted in a third gas-liquid separation zone 18. The second separation zone 10 is operated at a pressure of from about 275 to about 375 psig (1896–2586 kPa). The temperature range is from about 60 degrees F. to about 140 degrees F. (16–60 degrees C.). The hydrogen-rich vapor phase recovered from the first separation zone 5 by way of line 9 is therefore processed through a compressor means 11 and a cooling means 12 to be combined with the aforementioned liquid hydrocarbon phase from line 26. The combined stream enters the second separation zone by way of line 14, the temperature of said combined stream being reduced to about 100 degrees F. (38 degrees C.) by cooling means 13.

The liquid hydrocarbon phase that settles out in the second gas-liquid separation zone 10 at the last-mentioned conditions of temperature and pressure is substantially reduced in hydrogen and $C_1$–$C_2$ hydrocarbons, which comprise about 1.5 mole % thereof. This liquid hydrocarbon phase is recovered through line 16 and transferred to a fractionation column 17 for the further separation of normally gaseous and normally liquid hydrocarbon conversion products as described below. The hydrogen-rich vapor phase that forms in the second separation zone 10 comprises about 95 mole % hydrogen. This hydrogen-rich vapor phase is admixed with the previously described liquid hydrocarbon phase recovered from the first separation zone 5, and the mixture is then treated in the aforementioned third separation zone 18 at an elevated pressure relative to said second separation zone 10, and at substantially the same temperature. The third separation zone 18 is operated at a pressure of from about 675 to about 800 psig (4654–5516 kPa). The temperature range is from about 60 degrees to about 125 degrees F. (15–60 degrees C.).

The hydrogen-rich vapor phase is withdrawn from the second separation zone 10 by way of line 15 and passed through a compressor 19 and a cooling means 20 before combining with a liquid hydrocarbon stream from line 24, said liquid hydrocarbon stream originating in the first separation zone 5 and transferred to line 15 by means of a pump 25. The combined stream enters the third separation zone by way of line 21 after a final cooling to about 100 degrees F. (38 degrees C.) by a cooling means 22. The hydrogen-rich vapor phase that forms in the third separation zone represents the net hydrogen product of the reforming process. This vapor phase, comprising about 96 mole % hydrogen, is recovered through an overhead line 23.

The liquid hydrocarbon phase that settles out in the third separation zone 18 is recycled to the second separation zone 10 to effect the separation of the residual hydrogen and $C_2-$ hydrocarbons contained therein. Thus, the liquid hydrocarbon phase is recovered through line 26 and transferred to line 9 to be admixed with the hydrogen-rich vapor phase from the first separation zone 5 and treated in the second separation zone 10 in the manner previously described. The resulting liquid hydrocarbon phase that forms in the second separation zone is reduced to about a 1.5 mole % concentration of hydrogen and $C_2-$ hydrocarbons, and this hydrocarbon phase is withdrawn and transferred to fractionation column 17 via line 16 as aforesaid. Fractionation column 17 is a part of a fractionation zone which is comprised of several fractionation columns.

The liquid hydrocarbon stream in line 16 is increased in temperature by means of a heat exchanger 27 and introduced into a fractionation column 17, or debutanizer, at a temperature of about 450 degrees F. (232 degrees C.). The column, which is a part of a fractionation zone, is operated at a bottom temperature and pressure of about 582 degrees F. (306 degrees C.) and 265 psig (1827 kPa), and at a top temperature and pressure of about 175 degrees F. (79 degrees C.) and 260 psig (1793 kPa). Overhead vapors are withdrawn through line 28, cooled to about 100 degrees F. (38 degrees C.) by cooling means 29, and enter an overhead receiver vessel 30. A normally gaseous hydrocarbon product stream is recovered from the vessel 30, via line 31, as condensate, one portion thereof being recycled to the top of the column via line 32 for reflux purposes. The balance of the condensate is recovered through line 34, while the uncondensed vapors are discharged from the receiver via line 35. A normally liquid hydrocarbon product stream, or heavy stream, is recovered from the bottom of the column through line 33 at a temperature of about 530 degrees F. (277 degrees C.), cooled to about 205 degrees F (96 degrees C.) in heat exchanger 27, and discharged to storage through another cooling means which is not shown.

In accordance with the present invention, instead of discharging the overhead vapor in line 35 to the plant fuel gas system, it is mixed with the stream flowing to the second separation zone, which comprises hydrogen-containing vapor recovered from the first vapor-liquid separation zone and the liquid stream recovered from the third vapor-liquid separation zone.

The pressure in receiver vessel 30 is similar to that in line 14; thus line 35 is connected to line 14 in order to mix the overhead vapor with the vapor stream and liquid stream supplied to the second separation zone. In a different embodiment of the invention where the zones operate at pressure levels which are different from the above-described embodiment, it may be desirable to connect line 35 to a different location. For example, in order that the overhead vapor may pass through compressor 11, line 35 may be connected to line 9.

Figure 2:
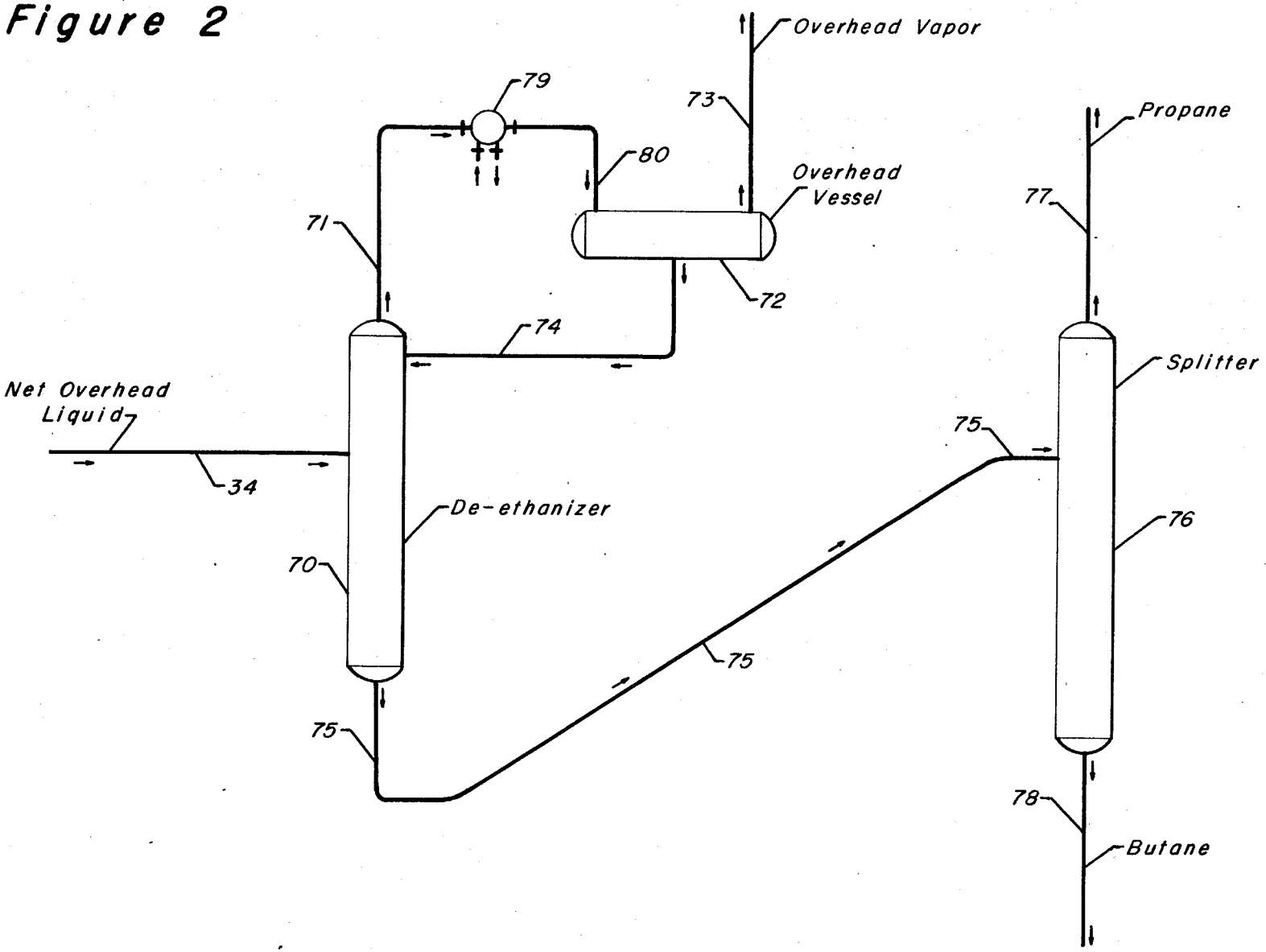
FIG. 2 is a continuation of the system of FIG. 1, depicting equipment utilized in further processing of the net overhead liquid stream from FIG. 1.

FIG. 2 depicts the balance of the fractionation zone of which fractionation column 17 is a part. Referring now to FIG. 2, the net overhead liquid in line 34 of FIG. 1 is supplied to a second fractionation column, deethanizer 70. Vapor from the top of deethanizer 70 passes through line 71 to heat exchanger 79 where it is cooled and partially condensed. Material from heat exchanger 79 passes through line 80 to overhead separator vessel 72, where vapor and liquid separate into liquid stream 74, which is returned to the deethanizer as reflux, and gas stream 73, which is routed to the plant fuel gas system. The vapor stream in line 73 is comprised primarily of hydrogen and $C_1$ and $C_2$ hydrocarbons.

The bottoms product from deethanizer 70 is provided to splitter 76 via line 75. Splitter 76 is a third fractionation column within the fractionation zone, in which the feed stream entering via line 75 is separated into a propane stream, which leaves splitter 76 by means of line 77, and a butane stream, which leaves the bottom of splitter 76 in pipeline 78.

The following tables set forth the composition and flow rates of certain relevant process streams from a proposed commercial design. The data is based on engineering design calculations. The numerical line designations are those appearing in FIGS. 1 and 2. The data in Table I describe a case in which the present invention is not practiced, that is, where the overhead vapor stream in line 35 is not routed to the second vapor-liquid recontacting zone, as shown in FIG. 1, but is instead routed to a use outside the process of FIG. 1, such as the plant fuel gas system. Table II sets forth data describing the same process as Table I, except that the Table II data applies where an embodiment of the present invention is practiced, that is, where the overhead vapor stream in line 35 is routed as shown in FIG. 1.

TABLE I

| Component, | Line Number | | | | |
|---|---|---|---|---|---|
| kg. mols/hr | 23 | 33 | 35 + 73 | 77 | 78 |
| $H_2$ | 3823.9 | — | 26.2 | — | — |
| $C_1$ | 188.7 | — | 12.7 | — | — |
| $C_2$ | 114.1 | — | 49.5 | 0.2 | — |
| $C_3$ | 44.7 | — | 77.9 | 35.8 | 0.8 |
| $C_4$ | 15.6 | 80.6 | 25.3 | 1.1 | 25.1 |
| $C_5$ | 5.7 | 132.8 | 0.3 | — | 1.0 |
| $C_6$+ | 12.7 | 3157.6 | — | — | — |
| Total | 4205.4 | 3371.0 | 191.9 | 37.1 | 26.9 |

TABLE II

| Component, | | | | | |
|---|---|---|---|---|---|
| kg.-mols/hr. | 23 | 33 | 73 | 77 | 78 |
| $H_2$ | 3850.0 | — | 0.5 | — | — |
| $C_1$ | 200.0 | — | 1.2 | — | — |
| $C_2$ | 145.0 | — | 18.1 | 0.5 | — |
| $C_3$ | 65.0 | — | 7.1 | 85.6 | 1.5 |
| $C_4$ | 17.2 | 80.5 | — | 2.8 | 48.4 |
| $C_5$ | 5.8 | 132.5 | — | — | 0.6 |
| $C_6$+ | 13.0 | 3157.6 | — | — | — |
| Total | 4296.0 | 3370.6 | 26.9 | 88.9 | 50.5 |

By comparing data in the tables, it can be seen that propane recovery increases by 139% and butane recovery increases by 88% as the result of practicing the invention. Also, the net gas, or hydrogen-rich stream contains more hydrogen; i.e., is improved hydrogen recovery by 0.7%. The heavy stream is decreased by a negligible amount.

In the design from which this data is taken, the value of debutanizer overhead vapor as fuel gas is $268.00 per metric ton, the heavy hydrocarbon stream is valued at $615.00, propane at $383.00, and butane at $475.00, all per metric ton. Based on these values and 8,000 operating hours per year, the value of the invention over a one year period is $22,954,050.00. This figure includes only the values of the various materials; added capital costs, utility costs, etc. are not included. However, these costs are not significant in comparison with the above value of the invention.

In another embodiment of the present invention, the overhead vapor streams from both the debutanizer and the deethanizer 70 are recycled instead of the deethanizer being used for fuel. In this embodiment line 73 of FIG. 2 is connected to line 35 of FIG. 1; this is depicted by the dashed line 73 of FIG. 1. When this embodiment of the invention is practiced, that is, when both overhead vapor streams are recycled, propane yield is increased by 6% and butane recovery is increased by 5% over the case in which only debutanizer overhead vapor is recycled. The net gas stream hydrogen content is improved by a negligible amount in the practice of this embodiment.

Figure 3:
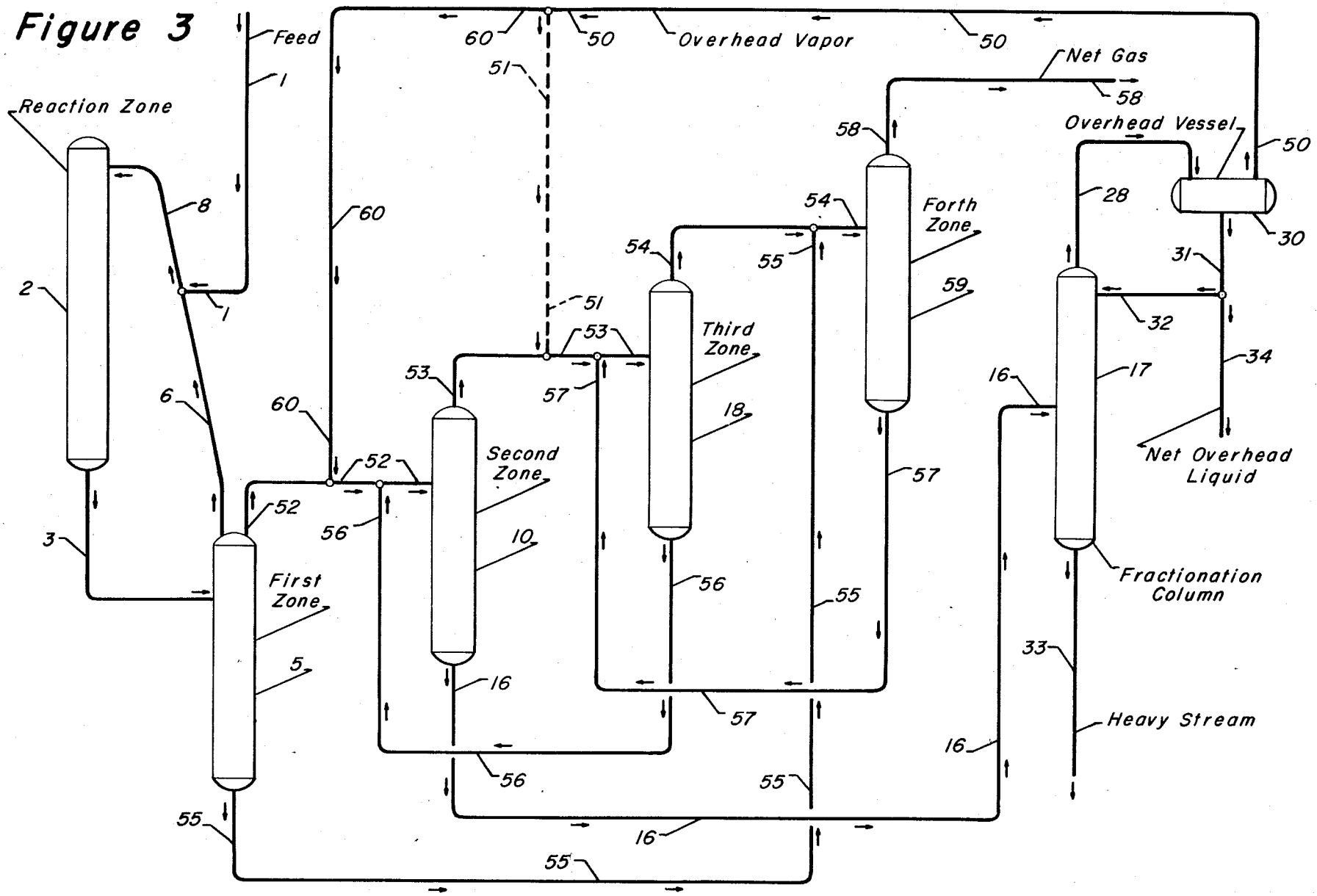
FIG. 3 is substantially identical to FIG. 1 except that an additional vapor-liquid separator is used and some equipment items which were shown on FIG. 1 are omitted for purposes of convenience in drawing.

FIG. 3 represents a process identical to that of FIG. 1 except that an additional vapor-liquid recontacting step is added and the routing of liquid streams from the separator vessels is altered to accommodate the fourth separator vessel. Reference numbers of FIG. 1 are reused in FIG. 3, but only where the item and function are identical. Fresh hydrocarbon feed is provided by means of line 1 and mixes with recycle gas in line 6 before entering reaction zone 2 via line 8. Effluent from reaction zone 2 flows to the first separation zone 5 via line 3. Vapor from the first separation zone is recycled to the reaction zone by means of line 6 and 8. Vapor from the first, second, and third separation zone is provided to the next separation zone by means of lines 52, 53, and 54 respectively. Liquid leaving the first separation zone 5 in line 55 is mixed with vapor from the third separation zone 18 and the mixture is provided to the fourth separation zone 59. Liquid from the third separation zone 18 flows through line 56 to line 52 to be mixed with vapor from first separation zone; the mixture is then fed to the second zone 10. Liquid from the fourth separation zone 59 flows in line 57 to be mixed with vapor from the second separation zone 10 and the mixture is supplied to the third separation zone. Liquid from the second separation zone flows through line 16 to fractionation column 17. In the same manner as described above, a heavy stream in line 33 and a net overhead liquid stream in line 34 are products of fractionation column 17. The net overhead liquid stream may then be treated as described above in connection with FIG. 2.

In accordance with the present invention, overhead vapor from vessel 30 flows through lines 50 and 60 to line 52, where it is mixed with liquid from the third separation zone and vapor from the first separation zone; the resulting mixture is then fed to the second separation zone. Alternatively, the overhead vapor may be routed via lines 50 and 51. Line 51 is shown as a dashed line to indicate that it is an alternative routing to line 60. If the overhead vapor is routed via line 51 it mixes with vapor from the second separation zone in line 53 and liquid from the fourth separation zone and the resulting mixture flows to the third separation zone. The choice of whether to add overhead vapor to the feed to the second separation zone or to the feed to the third separation zone depends on the pressure levels in the process system and is easily made by one skilled in the art. In the same manner as discussed above in regard to the three separation zone system of FIG. 1, overhead vapor in line 60, or line 51, may be routed either to the suction sides of the compressors in lines 52 and 53 (compressors not shown) or to the discharges of the compressors. Also in the same manner as the embodiment discussed above, deethanizer overhead vapor may be recycled by routing it to one of the recontacting stages. The improvements realized from the practice of the invention in this four separator system are similar in magnitude to those when a three separator system is used, both when debutanizer overhead vapor is recycled and when debutanizer and deethanizer overhead vapor is recycled. The choice of the number of separation zones, as well as the point at which recycled overhead vapor is to be added, is dependent upon system pressure and is easily made by one skilled in the art.

A separation zone may include one or more vapor-liquid separation vessels. In FIGS. 1 and 3, each separation zone is depicted as a single vessel. The term separation zone may also be used in a broader sense; for example, the three vessels, the coolers, and the compressors of FIG. 1 may be said to comprise a separation zone. In a like manner, a fractionation zone may be comprised of one or more fractionation columns.

We claim as our invention:

1. In a process for recovering the products of a hydrogen-producing hydrocarbon conversion reaction the improvement which comprises:

(a) passing a partially condensed hydrocarbon conversion reaction zone effluent stream comprising $C_5+$ hydrocarbons, methane, ethane, propane, butane, and hydrogen into a vapor-liquid separation zone which comprises at least two vapor-liquid separators and in which at least one vapor-liquid contacting step is performed whereby said effluent stream is separated into a hydrogen-rich net gas stream and a liquid stream, said reaction zone effluent stream being initially passed to a first vapor-liquid separator in said vapor-liquid separation zone to yield a first hydrogen-containing vapor stream and a first liquid stream and at least a portion of said hydrogen-containing vapor stream being passed to a second vapor-liquid separator in said vapor-liquid separation zone to yield a second hydrogen-containing vapor stream and a second liquid stream;

(b) passing the liquid stream to a fractionation column and recovering therefrom a heavy hydrocarbon stream, an overhead vapor stream, and an overhead liquid stream;

(c) passing at least a portion of the overhead vapor stream directly to the second of said vapor-liquid separators in said vapor-liquid separation zone;

(d) passing said overhead liquid stream to a deethanizer column and recovering therefrom an overhead vapor stream and a bottoms stream;

(e) passing said bottoms stream to a splitter column and recovering therefrom an overhead propane stream and a butane stream; and (f) recycling said overhead vapor stream from step (d) directly to the second of said vapor-liquid separators in said vapor-liquid separation zone.

2. The process of claim 1 further characterized in that said partially condensed hydrocarbon conversion reaction zone effluent stream comprises a catalytic reforming process effluent.

3. The process of claim 1 further characterized in that said fractionation column is a debutanizer.

4. In a process for recovering a hydrogen-rich gas stream, a light hydrocarbon stream, and a heavy hydrocarbon stream from a partially condensed effluent stream comprised of hydrogen, light hydrocarbons and heavy hydrocarbons recovered from a reaction zone in which a hydrocarbon conversion reaction is effected, the improvement comprising the steps of:

(a) passing said partially condensed reaction zone effluent to a first vapor-liquid separation zone maintained at conditions at which most $C_5+$ hydrocarbons are in a liquid phase and recovering therefrom a first hydrogen-containing vapor stream and a first liquid stream;

(b) mixing at least a portion of the first hydrogen-containing vapor stream with fractionation column overhead vapor defined in step (f) and a third liquid stream defined in step (e);

(c) passing the mixture of step (b) to a second vapor-liquid separation zone which is maintained at a higher pressure than the first vapor-liquid separation zone and recovering from said second zone a second hydrogen-containing vapor stream and a second liquid stream;

(d) mixing at least a portion of the second hydrogen-containing vapor stream with at least a portion of the first liquid stream and passing the resulting mixture to a third vapor-liquid separation zone which is maintained at a higher pressure than the second vapor-liquid separation zone;

(e) recovering from said third vapor-liquid separation zone a hydrogen-rich net gas stream and a third liquid stream, at least a portion of which third liquid stream is mixed with the first hydrogen-containing vapor stream in step (b):

(f) passing said second liquid stream to a fractionation column and recovering therefrom a light hydrocarbon liquid stream, a heavy hydrocarbon liquid stream, and fractionation column overhead vapor stream, at least a portion of which overhead vapor stream is mixed with the first hydrogen-containing vapor stream in step (b);

(g) passing said light hydrocarbon liquid stream to a de-ethanizer column and recovering therefrom an overhead vapor stream and a bottoms stream;

(h) passing said bottoms stream to a splitter column and recovering therefrom an overhead propane stream and a butane stream; and (i) recycling said overhead vapor stream from step (g) directly to said second vapor-liquid separation zone.

5. The process of claim 4 further characterized in that said partially condensed reaction zone effluent stream comprises a catalytic reforming process effluent.

6. The process of claim 4 further characterized in that said fractionation column is a debutanizer.

7. In a process for recovering a hydrogen-rich gas stream, a light hydrocarbon stream, and a heavy hydrocarbon stream from a partially condensed effluent stream comprised of hydrogen, light hydrocarbons and heavy hydrocarbons recovered from a reaction zone in which a hydrocarbon conversion reaction is effected, the improvement comprising the steps of:

(a) passing said partially condensed reaction zone effluent to a first vapor-liquid separation zone maintained at conditions at which most $C_5+$ hydrocarbons are in a liquid phase and recovering therefrom a first hydrogen-containing vapor stream and a first liquid stream;

(b) mixing at least a portion of the first hydrogen-containing vapor stream with the fractionation column overhead vapor defined in step (h) and a third liquid stream defined in step (e);

(c) passing the mixture of step (b) to a second vapor-liquid separation zone which is maintained at a higher pressure than the first vapor-liquid separation zone and recovering from said second zone a second hydrogen-containing vapor stream and a second liquid stream;

(d) mixing at least a portion of the second hydrogen-containing vapor stream with at least a portion of a fourth liquid stream defined in step (g) and passing the resulting mixture to a third vapor-liquid separation zone which is maintained at a higher pressure than the second vapor-liquid separation zone;

(e) recovering from said third vapor-liquid separation zone a third hydrogen-containing vapor stream and a third liquid stream, at least a portion of which liquid stream is mixed with the first hydrogen-containing vapor stream in step (b);

(f) mixing at least a portion of the third hydrogen-containing vapor stream with at least a portion of the first liquid stream and passing the resulting mixture to a fourth vapor-liquid separation zone which is maintained at a higher pressure than the third vapor-liquid separation zone;

(g) recovering from the fourth vapor-liquid separation zone a hydrogen-rich net gas stream and a fourth liquid stream, at least a portion of which fourth liquid stream is mixed with the second hydrogen-containing vapor stream in step (d);

(h) passing said second liquid strema to a fractionation column and recovering therefrom a light hydrocarbon liquid stream, a heavy hydrocarbon liquid stream, and a fractionation column overhead vapor stream, at least a portion of which overhead vapor stream is mixed with the first hydrogen-containing vapor stream in step (b);

(i) passing said light hydrocarbon liquid stream to a de-ethanizer column and recovering therefrom an overhead vapor stream and a bottoms stream;

(j) passing said bottoms stream to a splitter column and recovering therefrom an overhead propane stream and a butane stream; and (k) recycling said overhead vapor stream from step (i) directly to said second vapor-liquid separation zone.

8. The process of claim 7 further characterized in that said partially condensed reaction zone effluent stream comprises a catalytic reforming process effluent.

9. The process of claim 7 further characterized in that said fractionation column is a debutanizer.

10. In a process for recovering a hydrogen-rich gas stream, a light hydrocarbon stream, and a heavy hydrocarbon stream from a partially condensed effluent stream comprised of hydrogen, light hydrocarbons and heavy hydrocarbons recovered from a reaction zone in which a hydrocarbon conversion reaction is effected, the improvement comprising the steps of:

(a) passing said partially condensed reaction zone effluent to a first vapor-liquid separation zone maintained at conditions at which most $C_5+$ hydrocarbons are in a liquid phase and recovering therefrom a first hydrogen-containing vapor stream and a first liquid stream;

(b) mixing at least a portion of the first hydrogen-containing vapor stream with the third liquid stream defined in step (e);

(c) passing the mixture of step (b) to a second vapor-liquid separation zone which is maintained at a higher pressure than the first vapor-liquid separation zone and recovering from said second zone a second hydrogen-containing vapor stream and a second liquid stream;

(d) mixing at least a portion of the second hydrogen-containing vapor stream with fractionation zone overhead vapor defined in step (h) and at least a portion of a fourth liquid stream defined in step (g) and passing the resulting mixture to a third vapor-liquid separation zone which is maintained at a higher pressure than the second vapor-liquid separation zone;

(e) recovering from said third vapor-liquid separation zone a third hydrogen-containing vapor stream and a third liquid stream, at least a portion of which third liquid stream is mixed with the first hydrogen-containing vapor stream in step (b);

(f) mixing at least a portion of the third hydrogen-containing vapor stream with at least a portion of the first liquid stream and passing the resulting mixture to a fourth vapor-liquid separation zone which is maintained at a higher pressure than the third vapor-liquid separation zone;

(g) recovering from the fourth vapor-liquid separation zone a hydrogen-rich net gas stream and a fourth liquid stream, at least a portion of which fourth liquid stream is mixed with the second hydrogen-containing vapor stream in step (d);

(h) passing said second liquid stream to a fractionation column and recovering therefrom a light hydrocarbon liquid stream, a heavy hydrocarbon liquid stream, and a fractionation column overhead vapor stream, at least a portion of which overhead vapor stream is mixed with the first hydrogen-containing vapor stream in step (d);

(i) passing said light hydrocarbon liquid stream to a de-ethanizer column and recovering therefrom an overhead vapor stream and a bottoms stream;

(j) passing said bottoms stream to a splitter column and recovering therefrom an overhead propane stream and a butane stream; and (k) recycling said overhead vapor stream from step (i) directly to said third vapor-liquid separation zone.

11. The process of claim 10 further characterized in that said partially condensed reaction zone effluent stream comprises a catalytic reforming zone effluent.

12. The process of claim 10 further characterized in that said fractionation column is a debutanizer.

* * * * *